US007975859B2

(12) United States Patent
Sloat

(10) Patent No.: US 7,975,859 B2
(45) Date of Patent: Jul. 12, 2011

(54) INTERACTIVE WHITE BOARD TRACK SYSTEM

(75) Inventor: Tony Sloat, Centralia, IL (US)

(73) Assignee: Track Technology Systems, Inc., Fishers, IN (US)

( * ) Notice: Subject to any disclaimer, the term of this patent is extended or adjusted under 35 U.S.C. 154(b) by 425 days.

(21) Appl. No.: 12/177,989

(22) Filed: Jul. 23, 2008

(65) Prior Publication Data

US 2009/0101608 A1 Apr. 23, 2009

Related U.S. Application Data

(60) Provisional application No. 60/961,826, filed on Jul. 24, 2007.

(51) Int. Cl.
*A47F 5/08* (2006.01)

(52) U.S. Cl. ..... 211/94.01; 211/94.02

(58) Field of Classification Search ..... 248/317, 248/323, 466, 475.1, 476, 489; 16/96 R; 40/491, 617; 211/162, 94.01, 94.02
See application file for complete search history.

(56) References Cited

U.S. PATENT DOCUMENTS 1,000,551 A * 8/1911 Pickett ..... 16/100
1,067,678 A * 7/1913 Prim ..... 16/93 R
1,394,216 A * 10/1921 Parker et al. ..... 49/425
1,554,279 A * 9/1925 Helsabeck ..... 292/210
3,360,136 A * 12/1967 Ain ..... 211/162
3,796,405 A * 3/1974 Rystad ..... 248/489
3,883,004 A * 5/1975 Slaga ..... 211/162
4,552,991 A 11/1985 Hulls
4,570,033 A 2/1986 Hulls
4,853,715 A 8/1989 Paschkis
4,963,703 A 10/1990 Phillips et al.
5,737,740 A 4/1998 Henderson et al.
5,760,347 A 6/1998 Notarianni et al.
5,897,648 A 4/1999 Henderson
7,346,939 B2 * 3/2008 Perry ..... 4/557
7,661,640 B2 * 2/2010 Persson ..... 248/225.11

* cited by examiner

*Primary Examiner* — A. Joseph Wujciak, III
(74) *Attorney, Agent, or Firm* — Taft, Stettinius & Hollister LLP; Keith J. Swedo

(57) ABSTRACT

A track system for slidably mounting a frame. The track system includes an upper track parallel to a lower track, and the tracks may be mounted to a wall. A left carriage upright and a right carriage upright are aligned orthogonally to the tracks, and the carriage uprights are slidably connected to the tracks on each end through a roller assembly, each roller assembly having a wheel that is slidably mounted to the corresponding track. The wheel is kept on the track by a stop at either end of the track. A stabilizing support structure fixes the left carriage upright parallel to the right carriage upright. Finally, the carriage uprights each have a bracket at each end, the brackets adapted to hold a frame and projector screen in front of the carriage uprights. The projector screen, frame, carriage uprights, and stabilizing support structure may then slide laterally as a whole.

19 Claims, 5 Drawing Sheets

INTERACTIVE WHITE BOARD TRACK SYSTEM

CROSS-REFERENCE TO THE RELATED APPLICATIONS

This application claims the benefit of U.S. Provisional Application Ser. No. 60/961,826, Jul. 24, 2007

FEDERALLY SPONSORED RESEARCH

N/A

FIELD OF INVENTION

The present invention generally relates to a mounting device for an interactive white board in the classroom. The device allows the interactive white board to slide back and forth so that regular white board and chalk board space can be utilized.

BACKGROUND OF THE INVENTION

Interactive white boards are growing in popularity, and they are used in classrooms for students of all ages. An interactive white board is a framed screen that electronically responds to input from a user. Interactive white boards may have highly reflective (i.e., white or silver) screens used in conjunction with projectors, and they may also just have flat panel screens similar to a flat panel computer monitor. Regardless of the type of screen, the interactive white board is made large enough so that an entire classroom can benefit from its use.

Interactive white boards may be equipped with a specialized pen that allows the interactive white board to track the pen's movements as the pen is close to the surface of the interactive white board. Interactive white boards may also be equipped with a specialized surface that is responsive to pressure so that user input may need only to be a pressure applied to the surface of the screen, such as pressure from a pen, an eraser, or a finger. Interactive white board pens may also be pressure sensitive such that the pen communicates with the interactive white board about when the pen tip is being depressed.

Interactive white boards may also have buttons around a frame of the screen. These buttons may be programmed to do a variety of different tasks, depending on how the interactive white board is to be used. With the combination of a specialized screen, specialized buttons, and the large viewing area appropriate for a classroom, the interactive white board has steered the teaching community away from traditional white boards and chalk boards.

On the other hand, traditional white boards and chalk boards have advantages. In the event of a technology or power difficulty, teachers often prefer to have the traditional white board or chalk board to fall back on. However, traditional white boards and chalk boards do not provide the ease of saving information, or the visual stimulation of combined high end media and simple pen and screen. Thus, teachers accustomed to interactive white boards will often fall back on traditional white boards or chalk boards when necessary. A visual space problem has been created from the dual use of regular white boards and chalk boards along with interactive white boards in the classroom. Interactive white boards are frequently organized in classrooms on a stand that takes up floor space. While the stand may be mobile, it is less than ideal for a room already in need of extra floor space. Interactive white boards may also be fixed to the wall. However, there are already chalk boards and white boards taking up much of a classroom's wall space. Classrooms are often too small already, and crowding the wall space and floor space of a classroom with multiple teaching boards makes it difficult for teachers to effectively utilize regular white boards and chalk boards along with the interactive white board.

The subject invention provides a new way for interactive white board users to utilize regular white boards and chalk boards along with interactive white boards in the classroom. This invention allows an interactive white board to be mounted on the same wall space as an existing chalk board or white board, without sacrificing the utility of the chalk board or white board. By saving floor space and wall space, the subject invention allows teachers to maintain a central focus point in the classroom while allowing the teacher to use several tools to communicate from that focus point.

SUMMARY OF THE INVENTION

The present invention is a track system for slidably mounting a frame, such as the frame for an interactive white board, in front of a regular chalk board or white board. The invention allows the slidably mounted frame to be moved along the wall from in front of the regular chalk board or white board to a side position next to the regular white board or chalk board; and, the frame can be moved back in front of the regular white board or chalk board when it is desired. The invention allows the teacher to communicate consistently from a single focus point, maintain a consistent and flexible placement of the projector, and save wall space and floor space.

The track system disclosed and claimed herein comprises an upper track and a lower track each adapted to be mounted laterally to a wall, the upper track positioned parallel to the lower track, each track having a channel, a back, and a front face, each channel having a height spanning between a top of the channel and a bottom of the channel, the front face having an opening between the top of the front face and the bottom of the front face, the opening spanning a height less than the height of the channel; a left carriage upright and a right carriage upright each orthogonal to said tracks, each carriage upright having a front side and a back side, each carriage upright having a roller assembly on the back side at each end, each roller assembly having a wheel mounted on an axle, the axle attached to the carriage upright, and the wheel with a diameter slightly less than the height of the channel but more than the height of the opening, the wheel slidably mounted in the channel of the track; each carriage upright having a top bracket and a bottom bracket, each top bracket extending away from the front of the carriage upright and bending down, each bottom bracket extending away from the front of the carriage upright and bending up, the brackets adapted to hold a common rectangular frame; a stabilizing support structure, the stabilizing support structure fixing the left carriage upright parallel to the right carriage upright; and a stop at the end of each track, the stop keeping the wheel from rolling beyond the end of the track; wherein the carriage uprights, the stabilizing support structure, and the common rectangular frame slide laterally as a whole.

BRIEF DESCRIPTION OF THE DRAWINGS

It is to be expressly understood that the following figures are merely examples and are not intended as a definition of the limits and scope of the present invention.

DETAILED DESCRIPTION OF THE

Preferred Embodiments

Figure 1:
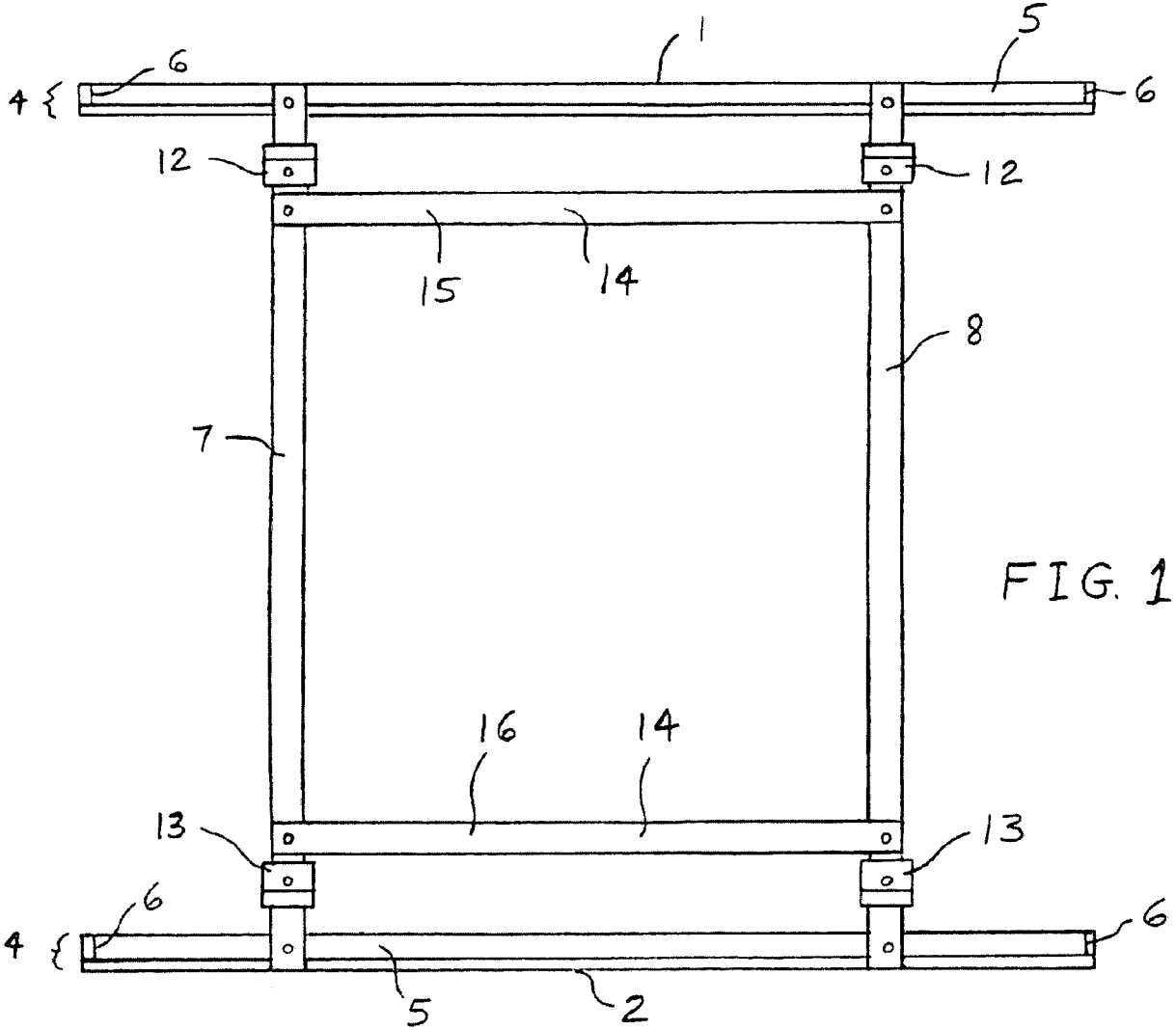
FIG. 1 is a front view of the track system.
Figure 4:
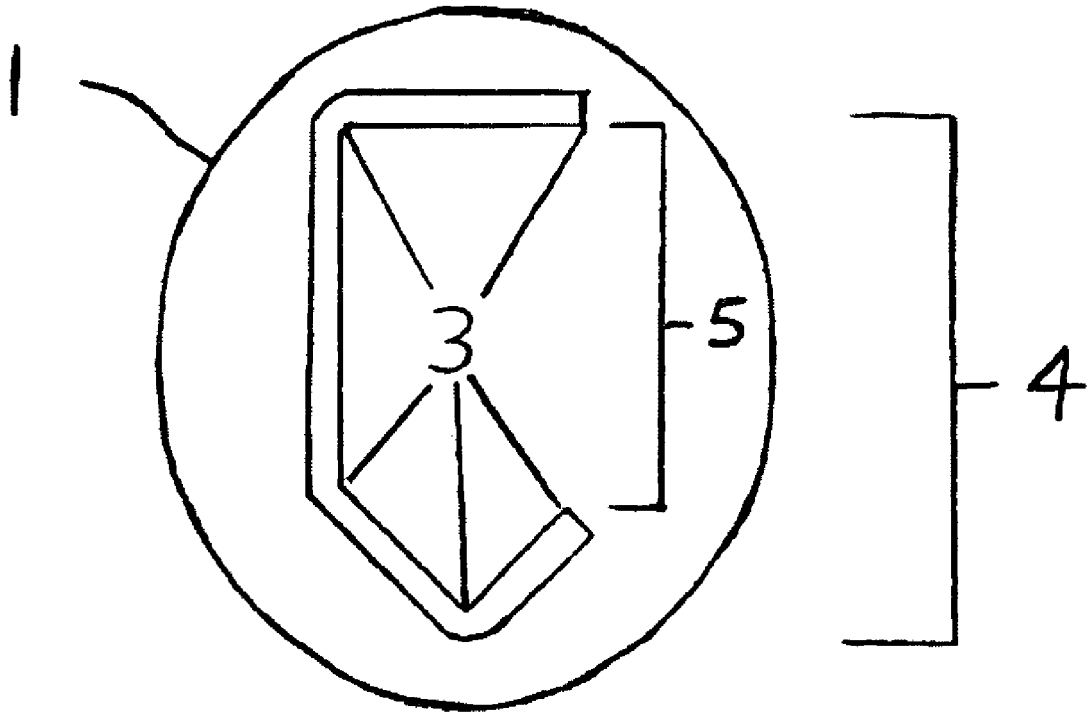
FIG. 4 is a side view of a track without a stop, showing the preferred shape of the upper track and the lower track.

FIG. 1 is a front view of the track system. An upper track 1 and lower track 2 are fixed to a wall. The tracks each have a channel height 4 measured from the top of the track channel (3 as shown in FIG. 4) to the bottom of the track channel. The tracks also each have a track opening 5 at the front, the height of which is less than the channel height 4. This difference in height allows a wheel to roll in the track without falling out the front of the track. The tracks have stops 6's at each end to keep the wheel from rolling out the end of the track. In one embodiment, each stop 6 is a screw extending from the top of the track to the bottom of the track.

Suspended orthogonally between the upper track 1 and lower track 2 is a left carriage upright 7 and a right carriage upright 8. These carriage uprights are fixed parallel to each other by a top stabilizer bar 15 and a bottom stabilizer bar 16. Together, these stabilizer bars make up a stabilizing support structure 14. The top stabilizer bar 15 and the bottom stabilizer bar 16 extend between the left carriage upright 7 and the right carriage upright 8.

At the top end of each of the left carriage upright 7 and the right carriage upright 8 is a top bracket 12, the top bracket 12 extending away from the front of the carriage upright and bending down. At the bottom end of each of the left carriage upright 7 and the right carriage upright 8 is a bottom bracket 13, the bottom bracket 13 extending away from the front of the carriage upright and bending up.

Figure 2:
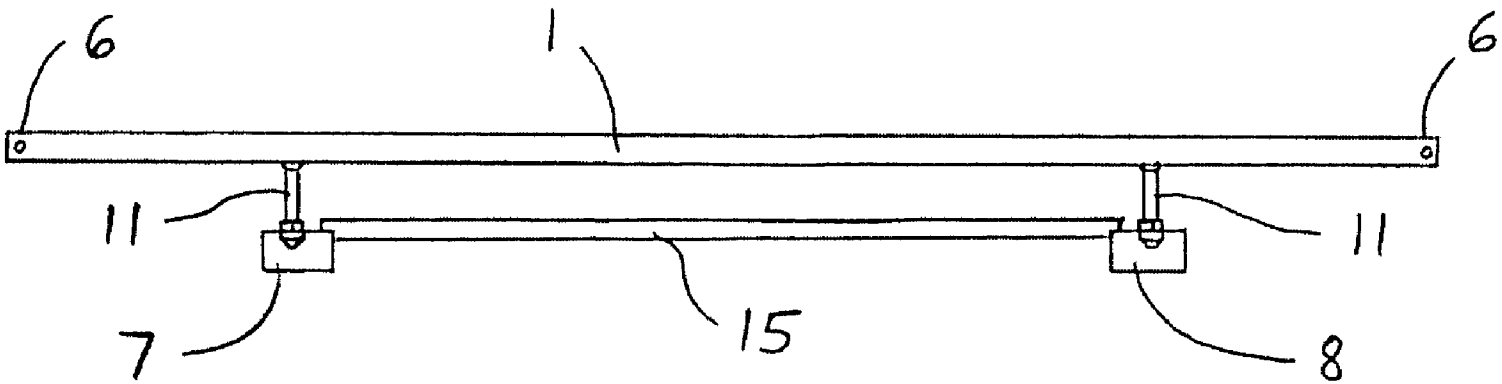
FIG. 2 is a top view of the track system.
Figure 3:
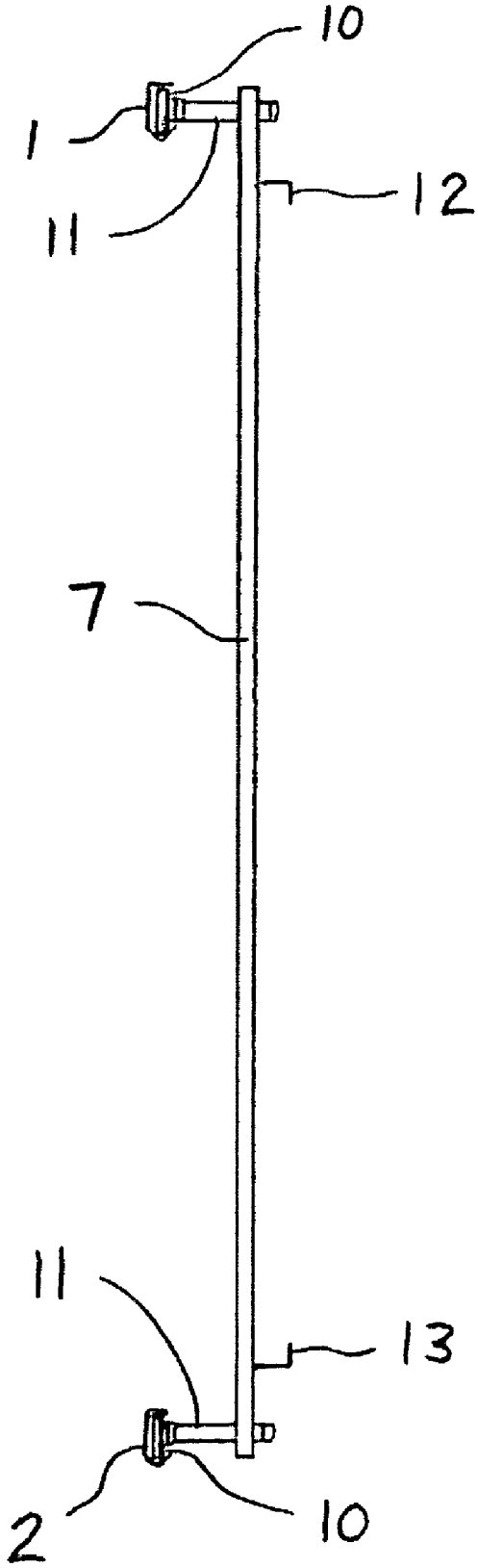
FIG. 3 is a side view of the track system.

FIG. 2 is a top view of the track system. The upper track 1 is shown, but the lower track 2 is not shown because it lies behind the upper track 1 in this view. Similarly, the top stabilizer bar 15 is shown, but the bottom stabilizer bar 16 is not shown because it lies behind the top stabilizer bar 15 in this view. An axle 11 extends between each track (only upper track is 1 shown) and each carriage upright (left carriage upright 7 and right carriage upright 8). The axle is attached to a carriage upright at one end and a wheel (10 as in FIG. 3) at the other end. As shown in FIG. 3, the wheel (10 as in FIG. 3) is slidably mounted in the track.

FIG. 3 is a side view of the track system. The left carriage upright 7 is shown, but the right carriage upright 8 is not shown because it lies behind the left carriage upright 7 in this view. A top bracket 12 is attached near the top of the carriage uprights (only left carriage upright 7 is shown), the top bracket extending away from the front of the carriage upright and bending down. A bottom bracket 13 is attached near the bottom of the carriage uprights, the bottom bracket extending away from the front of the carriage upright and bending up. An axle 11 is attached to each end of the carriage uprights, the axle 11 attached on the back side of the carriage upright at one end and to a wheel 10 at another end. The wheel 10 having a diameter slightly less than the channel height (4 as shown in FIG. 4) but more than the height of the track opening (5 as shown in FIG. 4). The wheel 10 and the axle 11 may be described together as the roller assembly. The wheel 10 is slidably mounted to a track (either to the upper track 1 or the lower track 2, as shown).

FIG. 4 is a side view of a track without a stop, showing the preferred shape of the upper track and the lower track. The upper track and the lower track may be shaped the same way, but the upper track 1 is shown in FIG. 4. The upper track has a track channel 3, which represents the inner region of the track. The upper track 1 has a front face, and the top of the front face of the track may be the same as the top of the track channel 3. The track, as shown, goes straight back from the top of the front face to the top of the back of the track. The bottom of the front face of the track is a portion of the track angled up towards the front of the track from the bottom of the track channel. The bottom of the back face of the track is a portion of the track angled up towards the back of the track from the bottom of the channel. FIG. 4 represents only one embodiment of the track shape. For the invention to work, it is only important that the channel height 4 is greater than the height of the opening 5. A number of shapes could be imagined that satisfy this criteria, including but not limited to a partial oval shape (not shown) or a square bracket with an opening on the front (not shown).

Figure 5:
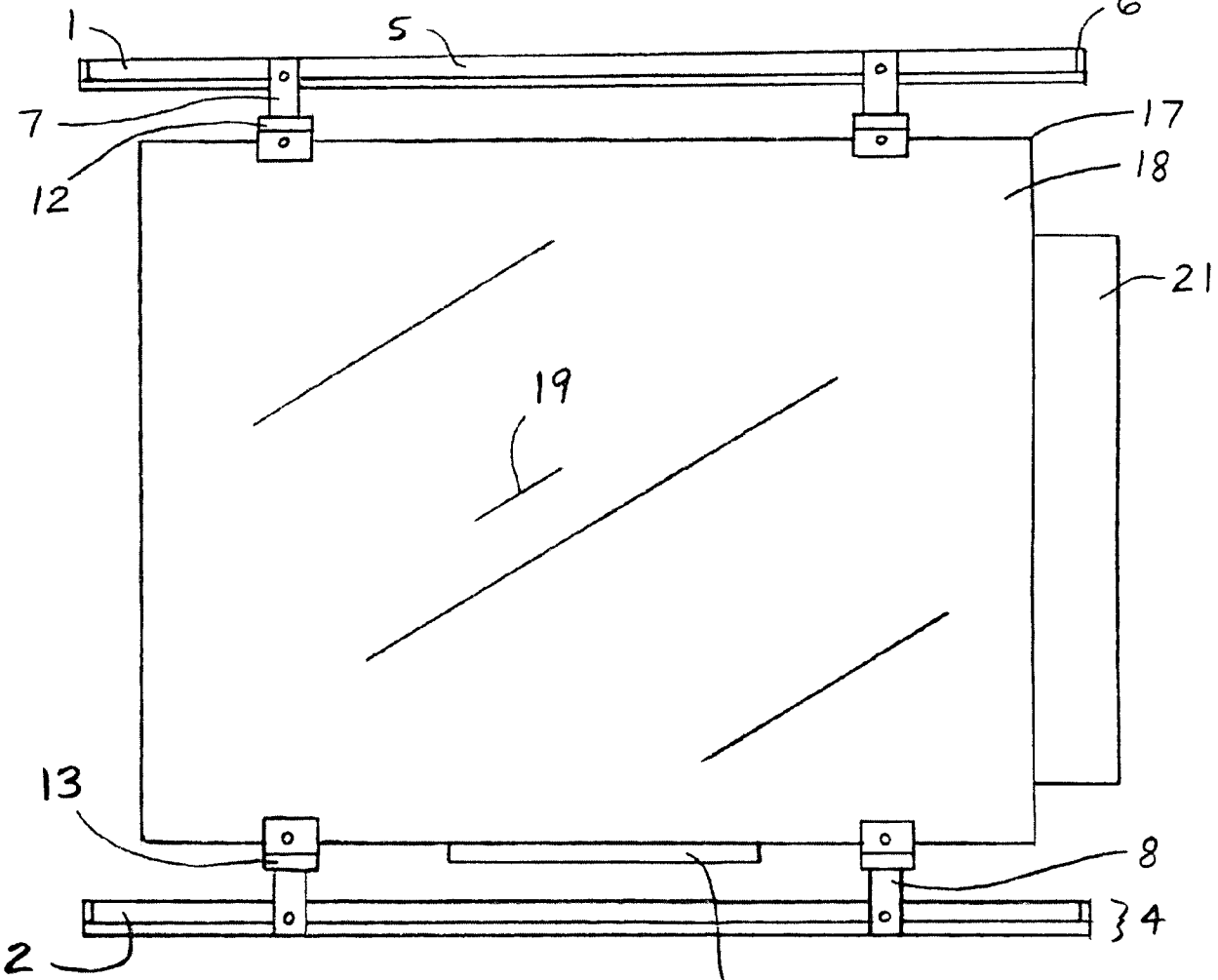
FIG. 5 is a front view of the track system with a rigid projector screen mounted in a frame held by the track system.

FIG. 5 is a front view of the track system with a rigid projector screen mounted in a frame held by the track system. An upper track 1 and lower track 2 are fixed to a wall. The tracks each have a channel height 4 measured from the top of the track channel (3 as shown in FIG. 4) to the bottom of the track channel. The tracks also each have a track opening 5 at the front, the height of which is less than the channel height 4. The tracks have stops 6's at each end to keep the wheel from rolling out the end of the track. Suspended orthogonally between the upper track 1 and lower track 2 is a left carriage upright 7 and a right carriage upright 8. The stabilizing support structure (14 as in FIG. 1) is not shown.

At the top end of each of the left carriage upright 7 and the right carriage upright 8 is a top bracket 12, the top bracket 12 extending away from the front of the carriage upright and bending down. At the bottom end of each of the left carriage upright 7 and the right carriage upright 8 is a bottom bracket 13, the bottom bracket 13 extending away from the front of the carriage upright and bending up. In between the top brackets 12's and bottom brackets 13's is a frame 17, the frame holding a projector screen 18. The brackets (12's and 13's) hold the frame and projector screen in place.

A specialized pen 19 may be used in combination with the projector screen, as is done on many interactive white boards. Also, frame buttons 20 may be on the frame 17 to allow users more interactivity. The features of interactive white boards can be fully integrated with the track system.

The track system may be mounted with the interactive white board in front of a regular white board 21, as shown. The interactive white board would then be able to slide to the right until a wheel (10 as in FIG. 3) hits a track stop 6 on the right side. The interactive white board would be able to slide back to the left until a wheel (10 as in FIG. 3) hits a track stop 6 on the left side.

The tracks, carriage uprights, and stabilizing support structure may be made from aluminum, in particular #3003-H14 alloy aluminum. The tracks, carriage uprights, and stabilizing support structure may also be powder coated or painted.

Due to the fact that interactive white boards come in various shapes and sizes, there is no one best size to make the track system. The upper track and the lower track should be of approximately the same size as each other, and the length of the track may be customized as needed. The left carriage upright and the right carriage upright should be approximately the same size as each other, and the desired height of the uprights may depend on the height of the regular white board or regular chalk board as well as the height of the interactive white board or interactive chalk board. The axle should be long enough to allow the carriage uprights to clear any obstructions (such as a regular white board or a regular chalk board) behind the carriage uprights on the wall. The top bracket and the bottom bracket may vary in depth depending on the thickness of the frame being mounted, and the top bracket and bottom bracket may vary in width and thickness depending on the weight of the frame being mounted. Heavier and thicker frames would need deeper, thicker, and wider brackets for support.

| Item | | Drawing Number | | | | |
|---|---|---|---|---|---|---|
| Number | Item Name | 1 | 2 | 3 | 4 | 5 |
| 1 | upper track | x | x | x | x | x |
| 2 | lower track | x | | x | | x |
| 3 | track channel | | | | x | |
| 4 | channel height | x | | | x | x |
| 5 | track opening | x | | | x | x |
| 6 | track stop | x | | | | x |
| 7 | left carriage upright | x | x | x | | x |
| 8 | right carriage upright | x | x | | | x |
| 10 | wheel | | | x | | |
| 11 | axle | | x | x | | |
| 12 | top bracket | x | | x | | x |
| 13 | bottom bracket | x | | x | | x |
| 14 | stabilizing support structure | x | | | | |
| 15 | top stabilizer bar | x | x | | | |
| 16 | bottom stabilizer bar | x | | | | |
| 17 | frame | | | | | x |
| 18 | projector screen | | | | | x |
| 19 | specialized pen | | | | | x |
| 20 | frame buttons | | | | | x |
| 21 | regular white board | | | | | x |

What is claimed is:

1. A track system for slidably mounting a frame, comprising: an upper track and a lower track each adapted to be mounted laterally to a wall, the upper track positioned parallel to the lower track, each track having a channel, a back, and a front face, each channel having a height spanning between a top of the channel and a bottom of the channel, the front face having an opening between the top of the front face and the bottom of the front face, the opening spanning a height less than the height of the channel; a left carriage upright and a right carriage upright each orthogonal to said tracks, each carriage upright having a front side and a back side, wherein the left carriage upright is placed on the left side of the frame and the right carriage upright is placed on the right side of the frame, each carriage upright having a roller assembly on the back side at each end, each roller assembly having a wheel mounted on an axle, the axle attached to the carriage upright, and the wheel with a diameter slightly less than the height of the channel but more than the height of the opening, the wheel slidably mounted in the channel of the track; each carriage upright having a top bracket and a bottom bracket, each top bracket extending away from the front of the carriage upright and bending down, each bottom bracket extending away from the front of the carriage upright and bending up, the brackets adapted to hold the frame; a stabilizing support structure, the stabilizing support structure fixing the left carriage upright parallel to the right carriage upright, wherein the stabilizing support structure is placed on either top or bottom of the frame; and a stop at the end of each track, the stop keeping the wheel from rolling beyond the end of the track; wherein the carriage uprights, the stabilizing support structure, and the frame slide laterally as a whole.

2. The track system of claim 1, wherein the stabilizing support structure comprises a top stabilizer bar and a bottom stabilizer bar, the stabilizer bars each attached to the left carriage upright on a first end and to the right carriage upright on a second end.

3. The track system of claim 2, wherein the top of the front face of the track is the top of the channel, and the bottom of the front face of the track is a portion of the track angled up towards the front of the track from the bottom of the channel; wherein the track angles up from the bottom of the channel to the back of the track; wherein the tracks, the carriage uprights, and the stabilizing support structure are made out of aluminum; wherein the tracks and the carriage uprights are painted with a matching color; wherein a whiteboard may be mounted on the wall between the tracks, the tracks made of a length that allows the rectangular frame to move from a position where the rectangular frame obstructs the whiteboard to a position where the rectangular frame does not obstruct the whiteboard; wherein a chalkboard may be mounted on the wall between the tracks, the tracks made of a length that allows the rectangular frame to move from a position where the rectangular frame obstructs the whiteboard to a position where the rectangular frame does not obstruct the whiteboard; wherein a rigid projector screen is mounted within the rectangular frame; wherein the rigid projector screen is adapted to accept and process user input; wherein the user input comprises the movement of a specialized pen;

wherein the user input comprises buttons on along the frame that are adapted to be pressed by a user.

4. The track system of claim 2, wherein the tracks, the carriage uprights, and the stabilizing support structure are made out of aluminum;

wherein the tracks and the carriage uprights are painted with a matching color;

wherein a whiteboard may be mounted on the wall between the tracks, the tracks made of a length that allows the rectangular frame to move from a position where the rectangular frame obstructs the whiteboard to a position where the rectangular frame does not obstruct the whiteboard; wherein a chalkboard may be mounted on the wall between the tracks, the tracks made of a length that allows the rectangular frame to move from a position where the rectangular frame obstructs the whiteboard to a position where the rectangular frame does not obstruct the whiteboard; wherein a rigid projector screen is mounted within the rectangular frame; wherein the rigid projector screen is adapted to accept and process user input; wherein the user input comprises the movement of a specialized pen; wherein the user input comprises buttons on along the frame that are adapted to be pressed by a user.

5. The track system of claim 2, wherein the tracks, the carriage uprights, and the stabilizing support structure are made out of aluminum;

wherein a whiteboard may be mounted on the wall between the tracks, the tracks made of a length that allows the rectangular frame to move from a position where the rectangular frame obstructs the whiteboard to a position where the rectangular frame does not obstruct the whiteboard; wherein a chalkboard may be mounted on the wall between the tracks, the tracks made of a length that allows the rectangular frame to move from a position where the rectangular frame obstructs the whiteboard to a position where the rectangular frame does not obstruct the whiteboard; wherein a rigid projector screen is mounted within the rectangular frame; wherein the rigid projector screen is adapted to accept and process user input; wherein the user input comprises the movement of a specialized pen; wherein the user input comprises buttons on along the frame that are adapted to be pressed by a user.

6. The track system of claim 1, wherein the top of the front face of the track is the top of the channel, and the bottom of the front face of the track is a portion of the track angled up towards the front of the track from the bottom of the channel.

7. The track system of claim 6, wherein the track angles up from the bottom of the channel to the back of the track.

8. The track system of claim 1, wherein the tracks, the carriage uprights, and the stabilizing support structure are made out of aluminum.

9. The track system of claim 1, wherein the tracks, the carriage uprights, and the stabilizing support structure are made out of #3003- H14 alloy aluminum.

10. The track system of claim 1, wherein the tracks and the carriage uprights are painted with a matching color.

11. The track system of claim 1, wherein a whiteboard may be mounted on the wall between the tracks, the tracks made of a length that allows the rectangular frame to move from a position where the rectangular frame obstructs the whiteboard to a position where the rectangular frame does not obstruct the whiteboard.

12. The track system of claim 1, wherein a chalkboard may be mounted on the wall between the tracks, the tracks made of a length that allows the rectangular frame to move from a position where the rectangular frame obstructs the whiteboard to a position where the rectangular frame does not obstruct the whiteboard.

13. The track system of claim 1, wherein a rigid projector screen is mounted within the rectangular frame.

14. The track system of claim 13, wherein the rigid projector screen is adapted to accept and process user input.

15. The track system of claim 14, wherein the user input comprises the movement of a specialized pen.

16. The track system of claim 14, wherein the user input comprises buttons on along the frame that are adapted to be pressed by a user.

17. The track system of claim 1, wherein the top of the front face of the track is the top of the channel, and the bottom of the front face of the track is a portion of the track angled up towards the front of the track from the bottom of the channel; wherein the track angles up from the bottom of the channel to the back of the track; wherein the tracks, the carriage uprights, and the stabilizing support structure are made out of aluminum; wherein the tracks and the carriage uprights are painted with a matching color; wherein a whiteboard may be mounted on the wall between the tracks, the tracks made of a length that allows the rectangular frame to move from a position where the rectangular frame obstructs the whiteboard to a position where the rectangular frame does not obstruct the whiteboard; wherein a chalkboard may be mounted on the wall between the tracks, the tracks made of a length that allows the rectangular frame to move from a position where the rectangular frame obstructs the whiteboard to a position where the rectangular frame does not obstruct the whiteboard; wherein a rigid projector screen is mounted within the rectangular frame; wherein the rigid projector screen is adapted to accept and process user input; wherein the user input comprises the movement of a specialized pen.

18. The track system of claim 1, wherein the tracks, the carriage uprights, and the stabilizing support structure are made out of aluminum;

wherein the tracks and the carriage uprights are painted with a matching color;

wherein a whiteboard may be mounted on the wall between the tracks, the tracks made of a length that allows the rectangular frame to move from a position where the rectangular frame obstructs the whiteboard to a position where the rectangular frame does not obstruct the whiteboard; wherein a chalkboard may be mounted on the wall between the tracks, the tracks made of a length that allows the rectangular frame to move from a position where the rectangular frame obstructs the whiteboard to a position where the rectangular frame does not obstruct the whiteboard; wherein a rigid projector screen is mounted within the rectangular frame; wherein the rigid projector screen is adapted to accept and process user input; wherein the user input comprises the movement of a specialized pen; wherein the user input comprises buttons on along the frame that are adapted to be pressed by a user.

19. The track system of claim 1, wherein the tracks, the carriage uprights, and the stabilizing support structure are made out of aluminum;

wherein a whiteboard may be mounted on the wall between the tracks, the tracks made of a length that allows the rectangular frame to move from a position where the rectangular frame obstructs the whiteboard to a position where the rectangular frame does not obstruct the whiteboard; wherein a chalkboard may be mounted on the wall between the tracks, the tracks made of a length that allows the rectangular frame to move from a position where the rectangular frame obstructs the whiteboard to a position where the rectangular frame does not obstruct the whiteboard; wherein a rigid projector screen is mounted within the rectangular frame; wherein the rigid projector screen is adapted to accept and process user input; wherein the user input comprises the movement of a specialized pen; wherein the user input comprises buttons on along the frame that are adapted to be pressed by a user.

* * * * *